United States Patent [19]

Wiener et al.

[11] 4,102,336

[45] Jul. 25, 1978

[54] APPARATUS FOR TRACTION THERAPY

[76] Inventors: Ingrid Wiener; Hans Wiener, both of 13, Rystavägen, Täby, Sweden

[21] Appl. No.: 717,608

[22] Filed: Aug. 26, 1976

[30] Foreign Application Priority Data

| | | | |
|---|---|---|---|
| Aug. 26, 1975 | [SE] | Sweden | 7509452 |
| Aug. 26, 1975 | [SE] | Sweden | 7509453 |
| Jun. 23, 1976 | [SE] | Sweden | 7607276 |

[51] Int. Cl.[2] ..... A61H 1/02

[52] U.S. Cl. ..... 128/75

[58] Field of Search ..... 128/75, 71, 69, 84, 128/70, 78; 272/120

[56] References Cited

U.S. PATENT DOCUMENTS

| | | | |
|---|---|---|---|
| 2,377,940 | 6/1945 | Hughes | 128/75 X |
| 2,733,922 | 2/1956 | Diego | 272/120 |
| 3,134,379 | 5/1964 | Nightingale | 128/75 |
| 3,413,971 | 12/1968 | Evans | 128/75 |
| 3,547,111 | 12/1970 | Viel | 128/75 |
| 3,556,090 | 1/1971 | Viel | 128/75 |
| 3,892,404 | 7/1975 | Martucci | 272/120 X |

FOREIGN PATENT DOCUMENTS

| | | | |
|---|---|---|---|
| 11,975 | 4/1896 | Switzerland | 128/75 |
| 883,964 | 12/1961 | United Kingdom | 128/71 |
| 1,187,011 | 4/1970 | United Kingdom | 128/71 |

*Primary Examiner*—John D. Yasko

*Attorney, Agent, or Firm*—Karl F. Ross

[57] ABSTRACT

An exercising apparatus, enabling the application of traction to various parts of the human body, comprises a rigid frame with two parallel limbs interconnected by at least one cross-bar to which a body-engaging strap is connected via a flexible link such as a chain. Each limb carries an adjustably mounted and self-locking handgrip which is grasped by a user lying on a supporting surface over which the frame is freely slidable, the user either pulling or pushing these handgrips while having his hip, neck or feet strapped to the frame. The handgrips, when unlocked, are swingable in planes transverse to their limbs and may also be slidable thereon by the user until the latter applies the traction-generating force, thereby immobilizing them in the selected position. The connecting link can also be slidably mounted on its cross-bar and made self-locking upon the application of traction.

16 Claims, 15 Drawing Figures

APPARATUS FOR TRACTION THERAPY

FIELD AND BACKGROUND OF THE INVENTION

Our present invention relates to an exercising apparatus for traction therapy by the autotraction method, particularly in the treatment of back, neck and hip complaints. Most of the known arrangements for these purposes are relatively elaborate and complicated with all their associated adjustment and driving devices and require the assistance of another person such as a doctor or physiotherapist for adjusting the tension etc, in order to achieve the correct degree of traction. It is, however, impossible to achieve an optimum effect from the treatment point of view, since the supervising person cannot himself sense the effect of the tractive force, the pressure of the bandage or the pain actually experienced. Moreover, treatment by elaborate and complicated forms of apparatus can be carried out only in treatment centers equipped therefor and consequently, as is usual in nursing, only at predetermined times. Special forms of apparatus are, for this purpose, required for the different forms of treatment, such as for example back and hip traction.

An apparatus for stretching the human spine and for strengthening and cramp-relieving its muscle system has become known (see German printed specification No. 1,278,698) which is in the form of a U-shaped yoke whose limbs are spaced by a distance exceeding the width of the user's body, strap means for the head, feet or pelvis being exchangeably secured to the central portion of the yoke. In this apparatus the limbs of the yoke are of such a length that the apparatus is operable by extended arms, placed alongside the body, and provided with rigidly arranged handgrips, which extend at right angles to the plane of the yoke. Thus the length of the limbs corresponds to approximately half the body length.

The application of such an apparatus is, thanks to its simplicity, not limited to treatment centers and does not necessarily entail the assistance of another person. The design was, however, unsuccessful in practice since it still suffers from a number of disadvantages. The U-shape with relatively long limbs entails, at the ends of the limbs where the handgrips are rigidly secured, a degree of resiliency which is highly undesirable and which can only be eliminated at the expense of an exceptionally massive and hence also heavy design of the yoke. Moreover, the rigid position of the handgrips extending in all directions at right angles to the plane of the frame is unsatisfactory for some treatment purposes.

OBJECT OF THE INVENTION

The object of the present invention is to provide an improved exercising apparatus of the above-mentioned kind, in which the disadvantages mentioned are eliminated or at least reduced.

SUMMARY OF THE INVENTION

An improved exercising apparatus according to our invention comprises a rigid frame, which may be substantially rectangular or U-shaped, with two parallel limbs interconnected by at least one transverse member of a length exceeding the width of a user's body whereby the user can lie down on a substantially horizontal supporting surface between the two limbs while being attached to the frame with the aid of a strap fastened to the transverse member. A pair of handgrips on the parallel frame limbs are within reach of the user strapped to the frame and can therefore be grasped for exertion of a manual force thereon whereby traction is applied to certain parts of the body, e.g., the back, the neck or the hip as more fully described hereinafter, the frame being slidable for this purpose on the supporting surface with reference to the recumbent user.

According to one aspect of our invention, the fastening means securing the strap to the transverse frame member include a sleeve slidably surrounding that member, the sleeve being longitudinally split between confronting formations which are engaged by a looped link whereby the sleeve is clamped to the frame member in a selected position by the tensioning of that link whenever the user exerts a traction-applying force on the handgrips.

According to another aspect of our invention, the handgrips are adjustably mounted on their limbs and are indexed or clamped in a selected position by the same type of force exertion. In the case of a U-shaped frame, the handgrips may be rotatable in a transverse plane perpendicular to these limbs and indexable in certain rotary positions by coacting formations such as notches and tongues urged into mating engagement by elastic connections which may be part of a resilient element passing through the tubular frame members. In other instances, especially with a rectangular frame in which the parallel limbs are stringers long enough to let the user's body be accommodated within the rectangle, the independently displaceable handgrips can be provided with self-locking formations by which they can be clamped in selected longitudinal and/or rotary positions upon being manually stressed in a traction-applying direction, advantageously upon being tilted into an extreme position with reference to a split sleeve to which they are fulcrumed for pivotal motion about an axis perpendicular to the respective limb.

BRIEF DESCRIPTION OF THE DRAWING

The above and other features of our invention will now be described in detail with reference to the accompanying drawing in which.

SPECIFIC DESCRIPTION

Figures 1, 2, 3A, 3B, 4:
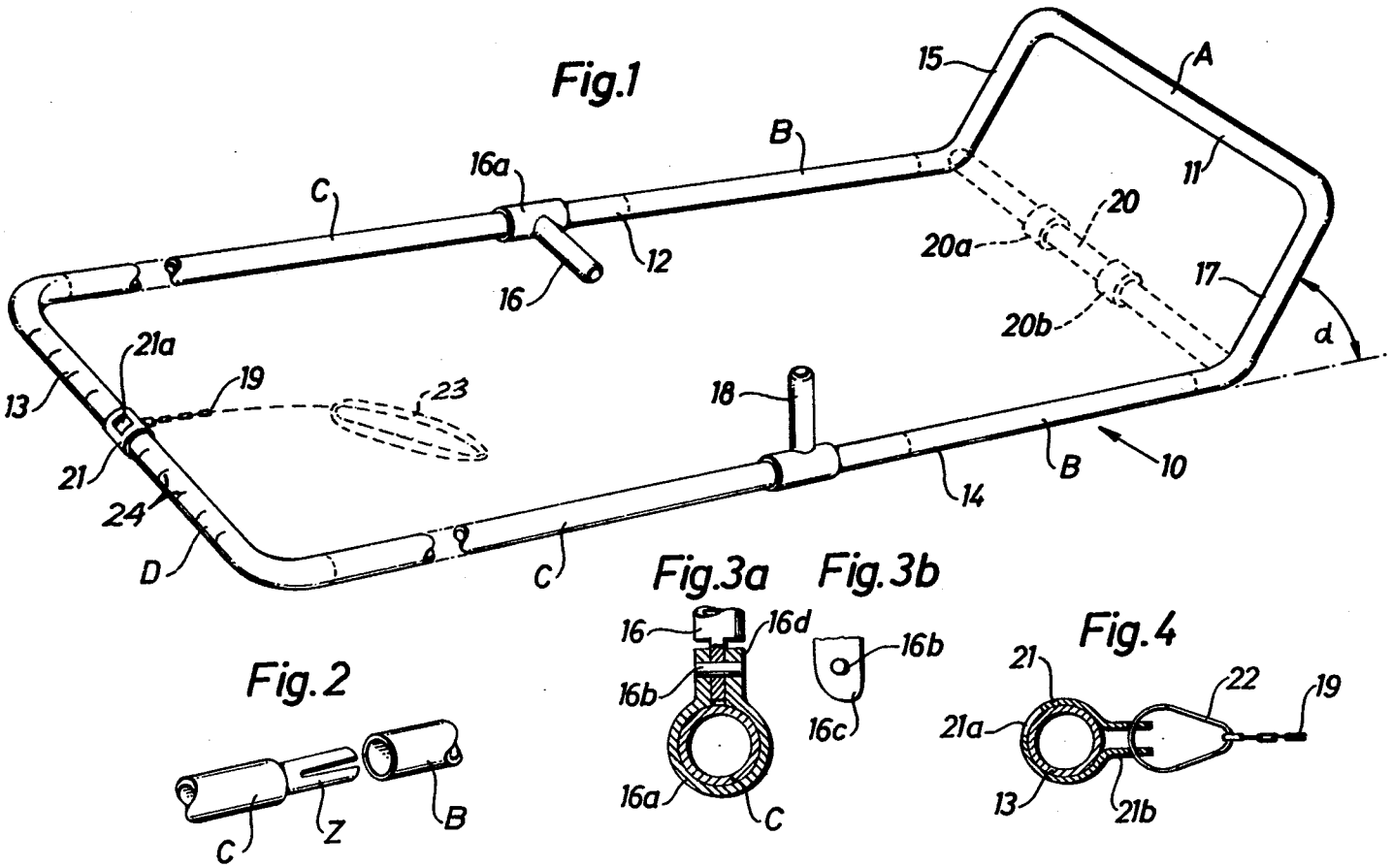
FIG. 1 is a diagrammatic view of the frame of the apparatus according to one embodiment of our invention.
FIG. 2 shows, on a larger scale, a possible construction of a connection between two sections of a dismantleable frame according to FIG. 1.
FIGS. 3*a* and 3*b* show details of a coupling serving to secure the handgrips to the frame of FIG. 1.
FIG. 4 shows a sliding sleeve engaging a connecting element.

According to FIG. 1, a generally rectangular rigid frame 10, made up of tubes of circular cross-section and having rounded corners, has two long sides 12, 14 and short sides 11, 13. The short sides form two transverse members or cross-bars, member 11 being raised relative to the remaining portions of the frame inasmuch as the long sides or stringers 12, 14 are bent upwardly at their adjacent terminal portions 15, 17 through an angle $\alpha$ which is preferably between approximately 70° and 110°. The difference in height between the cross-bar 11 and the remaining portions of the frame is advantageously of the order of magnitude of approximately 20 to 50 cm. The upwardly bent stringer portions 15, 17 may at the same time serve as an upper pair of handgrips, as will hereinafter be explained in greater detail. Primarily, however, a lower pair of handgrips 16, 18 are slidingly arranged on each stringer. The mounting of the handgrips 16, 18, making them slidable and securable in a selected position, may take a variety of forms, two of which will hereinafter be explained in greater detail with reference to FIGS. 3*a*, 3*b* and FIGS. 6 to 8, respectively.

At a plurality of joints shown dotted in FIG. 1 (or in full lines in FIG. 5) the frame 10 is divided into sections A, B, C, D. The joints may be made in the manner shown in FIG. 2, by means of a resiliently slotted tapered portion *z* at the end of each section, which is arranged for introduction into the aperture of the adjacent tubular section. It will, however, be appreciated that the connection could alternatively be made in one of many other known manners, e.g., by means of spring-loaded balls, as in the case of some dismantleable tent poles or the like.

In order to change the length of the frame, a corresponding pair of sections, such as for example tubes B or C, may be exchanged for a corresponding pair of different dimensions or may be of extendible (telescopic) construction.

The longitudinally adjustable handgrips 16, 18 are also adapted to pivot in a vertical transverse plane, parallel to the cross-bars 11, 13. These handgrips, of course, need not occupy the particular positions illustrated in FIG. 1, e.g., at right angles to the plane of the frame as shown for handgrip 18, but may be swung inwardly as well as outwardly and adjusted as required. The handgrip 16 is shown in a transport and storage position in which it is swung into the plane of the frame.

The pivoting of the handgrips into the transport and storage position may also take place about an axis parallel to the cross-bars 11, 13, as will be explained in greater detail in connection with FIG. 5.

According to FIG. 3*a*, a sleeve 16*a*, which slides on the frame 10 (here the section C thereof), has a central slot flanked by lugs 16*d* between which the lower part of the handgrip 16 is fulcrumed on a bearing pin 16*b*. According to FIG. 3*b*, the periphery of this lower part is shaped as a cam face 16*c*. When the handgrip 16 is raised into the upright position in which it comes up against an abutment (not shown), the cam face 16*c* locks the sleeve 16*a* with respect to the frame section C. In this construction, the slot in the sleeve need not extend beyond the region of the lugs 16*d*.

The second handgrip 18 is arranged in the same manner, but it will be appreciated that other locking mechanisms known per se may be used. Thus, for example, the arrangement shown in FIGS. 3*a*, 3*b* may be modified in such a way that the entire sleeve is longitudinally slotted and the lower part of the handgrip is made in the form of a stirrup whose two limbs embrace the lugs 16*d*. The inner faces of the stirrups and/or the outer faces of the lugs are in the form of cam faces, which cause the slot in the sleeve to become narrower when the handgrip is pivoted into the upright position, so that the sleeve firmly embraces the associated frame section and is thus locked in position. An alternative coupling will hereinafter be described in greater detail in connection with FIGS. 6 to 9. A further point of principle which should be mentioned is that, in case of a sectioned frame as shown in FIGS. 1, 2, the transverse swing of the handgrips may also readily be accomplished by rotating the entire section C concerned, on which the handgrips are mounted, about its longitudinal axis via its joints with the adjacent sections B and D.

The frame 10 may be augmented by a further transverse member 20, shown dotted in FIG. 1 (and in full lines in FIG. 5), so that it may, if desired, also be laid on a base surface, such as for example a treatment bench, which is narrower than the frame itself. Moreover, there may advantageously be provided on the transverse member 20 or, if no such member is present, on other parts of the frame at least two readily rotatable but not laterally displaceable wheels or rollers 20*a*, 20*b*, which are preferably provided with a friction-enhancing surface layer (e.g., rubber wheels). Thus, it will be appreciated that, if one of the user's arms is significantly stronger than the other, there is a certain danger of the frame being displaced to one side in the course of treatment. If the wheels are provided with a friction-enhancing surface, lateral displacements become less likely whereas the ease of displacing the frame with respect to the base surface in the longitudinal direction remains unimpaired, thanks to the rotation of the wheels or rollers.

In a practical embodiment of our invention the short sides 11, 13 of the frame are 60 cm long and the long sides 12, 14 measured from the location of the bend at 15, 17 to the opposite short side 13, are 160 cm long. Thus, the body of an adult person reclining within the frame is completely surrounded by it. It will, however, be appreciated that other dimensions may be employed, e.g. for use on particular groups of patients.

A flexible link such as for example a rope, strap or chain 19, designed to connect a belt or other strap member 23 to the frame, may advantageously be anchored to one of the cross-bars in a self-locking manner, e.g., by means of a slotted sleeve 21 as is shown in FIGS. 1 and 4, since for certain kinds of treatment it is desirable to attach the link not in a longitudinal plane of symmetry but in a preselected laterally offset position. We realize this transverse displaceability in a simple manner by means of the slotted sleeve 21, which is preferably provided with a viewing window 21*a* and which is simewhat smaller than the tubular frame section D which it embraces. The sleeve 21 has two lugs 21*b* with apertures for an appropriately profiled loop 22 to which the link 19 is connected. Tension in the link 19 has the effect of urging the lugs 21*b* toward each other, thanks to the ovoid shape of the loop 22, so that the sleeve 21 firmly embraces the cross-bar 13 whereby it is locked in position. In this embodiment, the cross-bar 13 or 11 carrying the apertured sleeve is advantageously provided with setting marks 24 such as scale gradations, differently colored regions etc. which can be read through the viewing window 21*a*.

When exercising by means of the apparatus according to the invention, the user may either pull the handgrips toward his shoulders in the conventional way or, in a novel manner, press against the handgrips. The lastmentioned possibility has turned out to be very advantageous and will be discussed in greater detail hereinafter in connection with the diagrams of FIGS. 10*a* and 10*b*. We have found that the ability of the handgrips to assume also an oblique position skew to the longitudinal centerline of the user's body, with an outward tilt, presents great advantages, because with the handgrips in the perpendicular position (illustrated for handgrip 18) the frame during pushing has a tendency to twist at its foot end about a transverse axis interconnecting the two handgrips with the result that part of the applied force may be lost.

Figure 5:
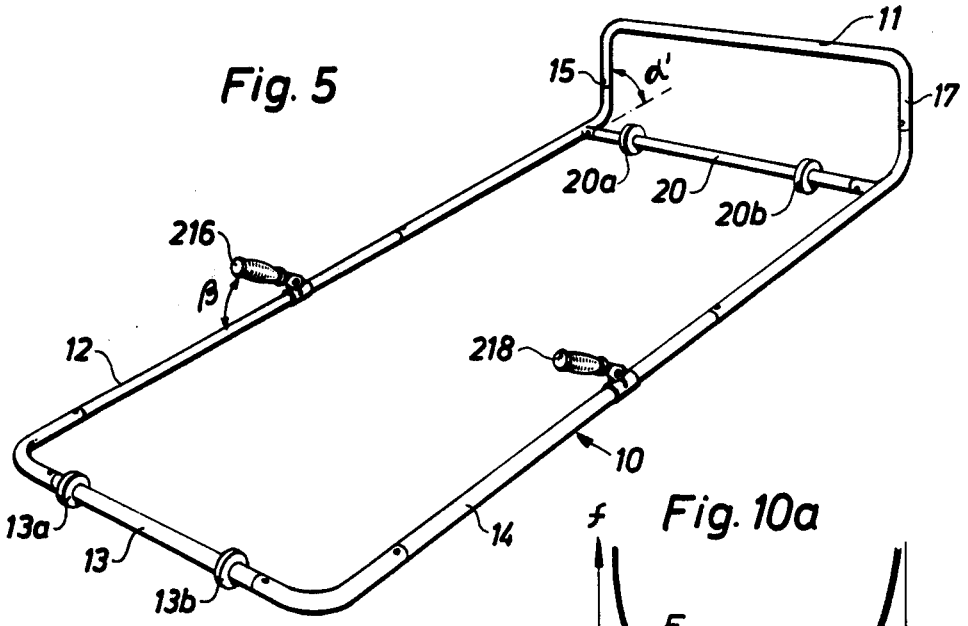
FIG. 5 shows a modification of the frame according to FIG. 1.

FIG. 5 shows a modification of the apparatus according to FIG. 1 in which, inter alia, the end portions 15, 17 of the stringers 12, 14 are bent through an angle $\alpha' = 90°$, the rollers 20*a*, 20*b* being supplemented by a second pair of rollers 13*a*, 13*b* on the opposite cross-bar 13 in order to reduce still further the friction with a base surface (not shown). In this connection, it will be appreciated that the rollers 13*a*, 13*b*, 20*a*, 20*b* could of course also be provided at different locations on the frame 10, e.g., directly on the stringers 12, 14. The handgrips 216, 218 are longitudinally displaceable, in a manner explained in greater detail hereinafter with reference to FIGS. 6 to 9, and so arranged that they can be brought into an operational position in which they include an acute angle $\beta$ with the long side concerned.

The lower end of the handgrip 216 (the handgrip 218 is of course of identical construction) is provided with a central slot 216*e* (FIG. 6) bounded by two side walls or cheeks 216*c* in which an aperture 216*f* is provided for a bearing pin 216*b* and whose lower edges 216*k* are inclined at a complementary angle $\beta' = 90°$ to a plane H (FIG. 7) which is at right angles to the longitudinal axis X of the handgrip.

A sleeve 216*a* (FIGS. 8 and 9) has lugs 216*d* with apertures 216*g* for the bearing pin 216*b* and also a pair of locking projections 216*h*. The sleeve 216*a* is longitudinally slotted at 216*i*, one lug 216*d* and one protection 216*h* being disposed on either side of the longitudinal slot 216*i*. The sleeve 216*a* further has a transverse slot 216*j*, separating the pair of projections from the pair of lugs, which penetrates deeply into the sleeve itself but does not extend all the way therethrough.

The projections 216*h* have upwardly converging upper regions *m*, whose free outer edges are spaced apart by a distance *n* somewhat less than the width *i* of the slot 216*e* in the handgrip 216. The distance *l* between the parallel outer faces of the lower regions *k* of the projections 216*h* is, on the other hand, somewhat larger than the width *i*.

Figure 7:
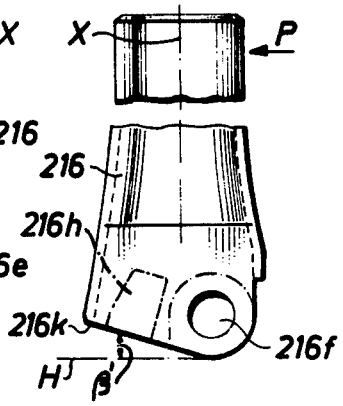

Let us consider a sleeve 216*a* embracing the stringer 12 and the handgrip 216 pivotally connected thereto by means of the bearing pin 216*b* in such a way that the lugs 216*d* lie within the handgrip, i.e., within the slot 216*e*. The dimensions *i, n, l* are so chosen that, when the handgrip 216 is inclined to its full extent to the right as viewed in FIGS. 7 and 9, the sleeve 216*a* can slide freely along the stringer 12 and can be pivoted about the latter, so long as the lower portions *k* of its locking projections 216*h* are not clamped tightly by the side walls 216*c* of the slot 216*e* when the handgrip is raised. The sleeve can thus, precisely in the same manner as in the embodiment according to FIGS. 1, 3*a*, 3*b*, be displaced along the stringer 12 into any selected position and given any desired oblique orientation about this frame side (inwardly, outwardly or perpendicularly upwardly). When the selected position has been set, the handgrip 216 is fully raised until the edges 216*k* abut against the sleeve 216*a* along the outer faces of projections 216*h*. Now the handgrip is locked in an operational position in which it includes the angle $\beta$ with the associated stringer. In FIG. 7 the positions of the lugs 216*f* and of the projections 216*h* inside the handgrip 216 in the latter's terminal position are indicated by chain-dotted lines. When the user pushes in the direction of the arrow P (FIG. 7) the locking engagement is made even firmer.

In the case of a frame 10 which is made up of disengageable sections, as is shown in FIG. 1 as well as FIG. 5, the sleeve 216*a* may be slipped onto the stringer 12 in either direction, i.e., for pushing from the frame end 11 or from the frame end 13.

From FIGS. 6 to 9 it is apparent that the locking projections 216*h* may also be dispensed with if the side walls 216*c* of the slot 216*e* and/or the external walls of the lugs 216*d* define cam faces which cause the lugs to be urged toward each other only in the operational position of the handgrip while permitting slidable displacement and rotation of the sleeve in a reverse-swung position of the handgrip. For the inclined position of the handgrips, which is advantageous for pressing exercises, the slant of the edges 216*k* in relation to the plane H at a given angle $\beta'$ is of importance.

Figure 10A:
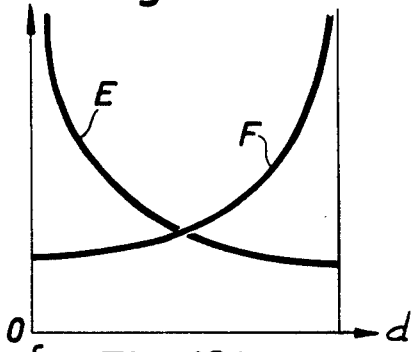
FIGS. 10*a* and 10*b* are diagrams respectively showing the force transmission and the force variation for a conventional exercising apparatus and for one embodying the invention.
Figure 6:
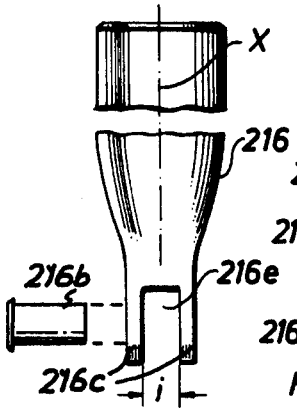
FIGS. 6 to 9 show details of a coupling securing the handgrips to the frame of FIG. 5.
Figure 10B:
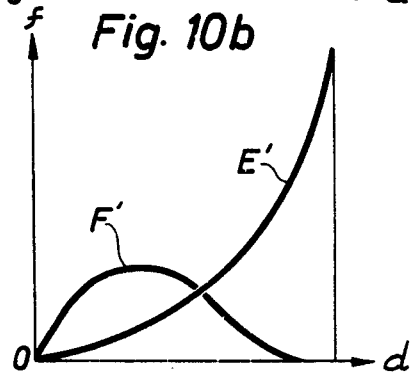
Figure 8:
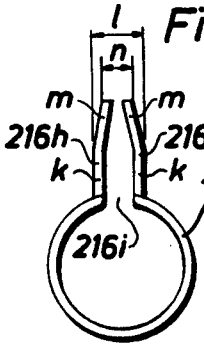
Figure 9:
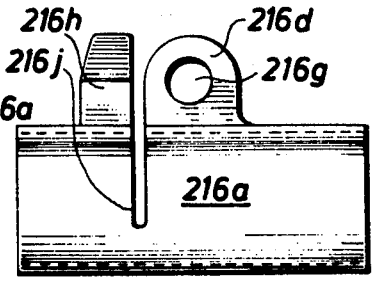
Figure 11:
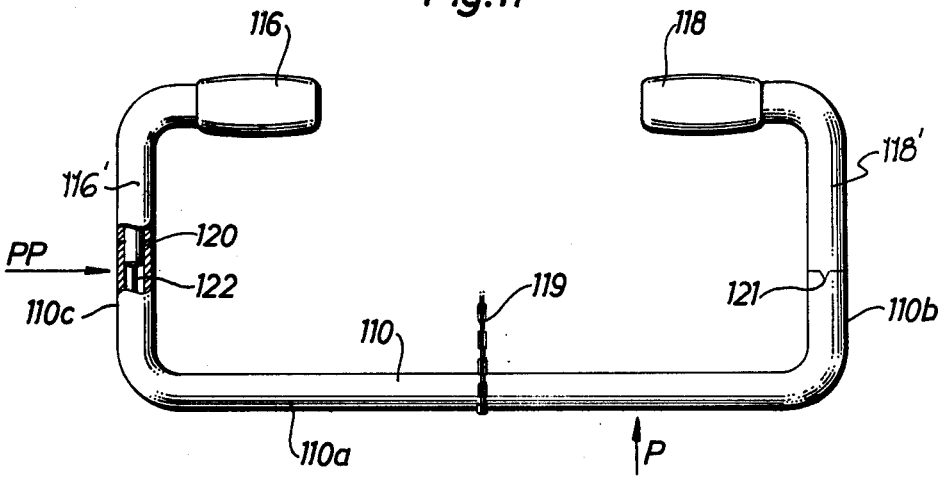
FIGS. 11 to 13 show diagrammatically a further embodiment of our improved exerciser in plan, front and side view, respectively.
Figure 12:
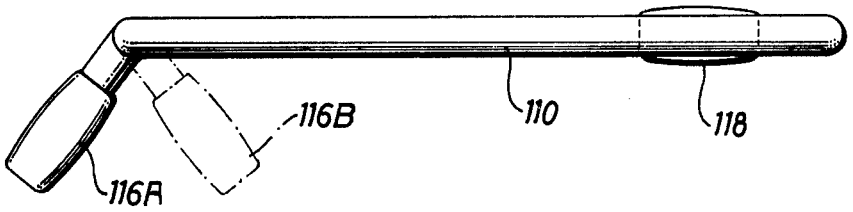
Figure 13:
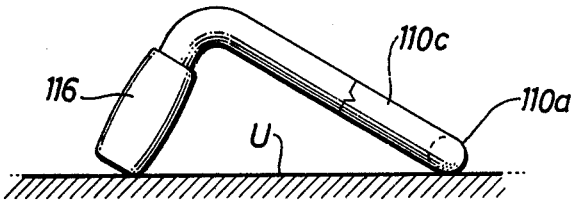

Before explaining in greater detail the manner in which the apparatus according to the invention is used, inter alia with reference to the diagrams of FIGS. 10*a* and 10*b*, we shall now describe, with reference to FIGS. 11 to 13, an exceptionally space and weight-saving embodiment of the apparatus according to the invention in which the frame 110 is yoke-shaped and has a single transverse member 110*a* with bent extremities 110*b*, 110*c*. These extremities 110*b*, 110*c* define limb portions into which handgrips 116, 118 with elbow-shaped extensions 116', 118', which carry bearing pins 120, are rotatably inserted. A connecting link 119 for a strap member such as the belt 23 of FIG. 1 is attached to the transverse member 110 in any desired position, e.g., in the manner shown in FIGS. 3 and 4. The abutting edges of the extensions 116', 118' of the handgrips 116, 118 and of the limb portions 110*b*, 110*c* have complementary indexing formations 121 defined by co-operating notches and tongues which yieldably retain the parts in one or more relative pivotal positions as shown in FIG. 12 for handgrip 116. The two handgrips 116, 118 are interconnected inside the frame 110 by means of an elastic element 122 (such as for example an elastic cable and/or a helical spring). Slight stretching of this elastic element enables each handgrip to be readily moved from one indexed position into the other. The length of frame member 110*a* somewhat exceeds the width of a user's body.

Although, for the sake of clarity, only one pair of co-operating indexing formations 121 are shown in FIG. 11 on the right-hand handgrip 118, they can of course be multiplied to provide for any desired number of such positions, and on both handgrips. In FIG. 12, for example, an outwardly directed operational position is shown at 116A and an inwardly directed operational position at 116B for handgrip 116 while handgrip 118 is shown pivoted into the transport and storage position. In practice, of course, both handgrips are set to the same indexing position at any time.

FIG. 13 shows the operational position of the complete apparatus on a base surface U. With this construction the handgrips 116, 118 automatically assume the above-described advantageous angle of inclination $\beta$. The user's head should be imagined on the left-hand side, allowing him to grasp the handgrips as he lies on the surface U with this bent knees above frame member 110*a*.

The operation of the apparatus according to the invention will now be explained in greater detail with reference to some examples.

EXAMPLE 1

Back-Traction Therapy

The frame 10 or 110 is placed on any desired base surface U; this may, if desired, be an ordinary bed, the floor of a livingroom, etc. When the frame 10 is utilized, the head of the user is at the elevated cross-bar 11. The belt 23 is extended around the body of the user with its lower edge resting against the hip bone. By means of a link such as the chain 19 or 119, the belt is secured in the above-described manner to the frame 10 or 110. The user lies down on the base surface in a dorsal position and with his knees raised (the frame 110 is pushed into the free space below the knees) grabs the handgrips 16, 18 (or 116, 118 or 216, 218) and sets them to the desired position. He then forcefully thrusts the frame away by pushing against the handgrips, whereby the desired traction is achieved. In the case of the frame 10, the same traction may also be achieved by the user grabbing and pushing against the cross-bar 11 or the bent stringer portions 15, 17 functioning as a pair of upper handgrips, intermittent traction being achieved by alternate force application and relaxation. In the case of the frame 110, the handgrips are used in the outwardly pivoted position (116A) during pushing (moment 1). At the end of the pushing movement the handgrips are pivoted into the inner position (116B) and the user's arms are braced in this stretched position, so that the traction can be maintained with minimum application of force as long as desired (moment 2). By raising his lower arms and handgrips 116, 118, the user reduces the traction force (moment 3), and by alternating between moments 3 and 2 the intermittent exercise is carried out.

EXAMPLE 2

Neck-Traction Treatment

The apparatus and the user adopt the same position as in Example 1. A neck belt is secured around the head and attached to the cross-bar 11 of the frame 10 by means of a connecting link. The handgrips 16, 18 are set to the desired position and pulled toward the user's shoulders whereby the desired stretching of the neck is achieved. Alternatively, the user may achieve the same stretching by gripping the cross-bar 11 or the stringer portions 15, 17 and pushing thereagainst.

EXAMPLE 3

Hip-Traction Treatment

The user places his feet below the raised cross-bar 11 of the frame 10. A pelvic belt 23 is secured in the groin region and fixed to the cross-bar 13 by means of link 13. A leg belt is strapped on above the knee and fixed to the cross-bar 11 by means of another link. The user then pushes the handgrips 16, 18 or 216, 218 away, i.e., he presses against them, whereby the desired traction is achieved.

The apparatus according to the invention can thus be used in many cases either in the conventional pulling mode or in our new pushing mode. The force transmission, i.e., the ratio between the muscle force applied and the magnitude of the external force acting on the apparatus, has a much more advantageous characteristic in the pushing mode as will become apparent from a study of FIGS. 10*a* and 10*b*. The exertion of the user is substantially reduced and approaches zero toward the end. In the diagrams the applied muscle force $f$ is plotted against the path length or distance $d$. In FIG. 10*a* the curve E shows the characteristic for the force transmission in conventional traction by pulling and the curve F shows the same for pushing while using the apparatus according to the invention. In FIG. 10*b* the curves E′ and F′ show the muscle force required for pulling and pushing, respectively.

The manner in which the required force is produced can be compared with the stressing of a spring, since that force increases with distance. In order to achieve the maximum force by the conventional pulling method, beginning with the arms fully extended (where the largest force-transmission ratio is available), the arms are gradually bent (curve E′ in FIG. 10*b*). In the initial position, however, the applied force is practically equal to zero, so that the large transmission ratio available is not utilized at all. With progressive bending of the arms to reach the final force, the transmission ratio or force amplification is reduced although the force requirement increases ("the spring is stressed")-curve E in FIG. 10*a*. These two variables act directly in opposition to each other and the maximum effort is limited by the muscle force of the user, for which reason it is not possible to reach it at all in the case of some individuals.

In the apparatus according to the invention, the conditions are precisely the reverse when pushing. In the initial position, in which the required effort is equal to zero, the force-transmission ratio is a minimum (curve F in FIG. 10*a*). It then increases gradually to the extent to which the arms are stretched. When the arms are stretched to their full extent in the final position (moment 2 in Example 1, curve F′ in FIG. 10*b*), the muscle force required reaches zero, which is caused by the fact that the transmission ratio increases at a greater rate than the force requirement.

The maximum final force can readily be selected by the angle of the arms in the initial position, i.e. by appropriate setting of the position of the handgrips along the stringers.

The apparatus according to the invention has a very wide field of application, as will be apparent from the foregoing description. One and the same apparatus may be used for back, neck and hip traction. By lateral displacement of the point of the attachment of the connecting link, so-called diagonal traction can readily be achieved. The fact that the user can work the apparatus by himself does, of course, by no means exclude the co-operation of a doctor or physiotherapist (e.g., for the purpose of a more varied treatment).

Owing to the fact that the relatively light apparatus (an exemplary embodiment of the frame 10 weighs approximately 8 kg) can be displaced along the base surface with minimum friction, as opposed to the user's body which is relatively heavy and produces a greater degree of frictional resistance, the forces are utilized most effectively.

The fact that the user may rest on the same base surface immediately after the exercise, without having to go elsewhere, presents a further advantage. The small apparatus, particularly in the embodiment according to FIGS. 11 to 13, can easily accompany the user on journeys, etc. The user does not have to depend on the hours of business of treatment centers and can, in the event of acute deterioration of his disorder, immediately benefit from traction treatment at home. Since the user meters the traction force himself by his own muscular effort, this force is immediately reduced by inhibition owing to pain, as soon as there is any danger of oversexertion.

We claim:

1. An exercising apparatus for the application of traction to the body of a user, comprising:

a rigid frame adapted to slide on a generally horizontal supporting surface, said frame having a pair of parallel limbs interconnected by at least one transverse member and separated by a distance greater than the width of the user's body;

strap means engageable with the user's body;

fastening means for securing said strap means to said frame, said fastening means including a looped link and a sleeve slidably surrounding said transverse member, said sleeve being longitudinally split between a pair of confronting formations engaged by said looped link; and a pair of handgrips on said limbs within reach of a user recumbent therebetween on said supporting surface and tied to said frame by said strap means whereby traction can be exerted upon the user's body with simultaneous clamping of said sleeve to said transverse member by the tensioning of said looped link.

2. An exercising apparatus as defined in claim 1 wherein said transverse member is provided with markings indicating the position of said sleeve thereon.

3. An exercising apparatus as defined in claim 2 wherein said sleeve is provided with a window enabling viewing of said markings therethrough.

4. An exercising apparatus for the application of traction to the body of a user, comprising:

a rigid, substantially U-shaped frame adapted to slide on a generally horizontal supporting surface, said frame having a pair of tubular parallel limbs interconnected by a tubular transverse member whose length exeeds that of said limbs and is greater than the width of the user's body whereby said transverse member is positionable under the bent knees of the user lying between said limbs on said supporting surface;

strap means engageable with the user's body and fastened to said transverse member, said limbs having free ends pointing toward the head of the user whose body is tied to said frame by said strap means;

a pair of handgrips respectively secured to said free ends, said handgrips being rotatable in a transverse plane perpendicular to said limbs between a plurality of operating positions; and a resilient element passing through said transverse member and emerging from said limbs, said handgrips having extensions anchored to opposite ends of the said resilient element and provided with formations urged by said resilient element into mating engagement with complementary formations on said limbs whereby said handgrips are yieldably retained in selected operating positions under pressure of the arms of the user grasping said handgrips.

5. An exercising apparatus as defined in claim 4 wherein said extensions are elbow-shaped tubes in line with said limbs.

6. An exercising apparatus as defined in claim 4 wherein said handgrips are inclined at an acute angle to said supporting surface in certain of said operating positions.

7. An exercising apparatus for the application of traction to the body of a user, comprising:

a rigid, substantially rectangular frame adapted to slide on a generally horizontal supporting surface, said frame including a pair of parallel stringers extending along the major sides of the rectangle at a distance from each other greater than the width of the user's body, a first cross-bar extending at one minor side of the rectangle and defining with said stringers a plane parallel to said supporting surface, and a second cross-bar elevated above said plane at the opposite minor side of the rectangle;

strap means engageable with the user's body;

fastening means for securing said strap means to one of said cross-bars; and a pair of adjustable handgrips on said stringers within reach of a user recumbent therebetween on said supporting surface and tied to said frame by said strap means, said handgrips being independently displaceable on said stringers and being provided with self-locking formations for clamping said handgrips in selected operating positions upon manual stressing of said handgrips by the user with reference to said one of said cross-bars in a direction applying traction to the user's body.

8. An exercising apparatus as defined in claim 7 wherein said stringers are of sufficient length to accommodate the user's body within the rectangle.

9. An exercising apparatus as defined in claim 7 wherein said frame is provided with rollers.

10. An exercising apparatus as defined in claim 7 wherein said frame is composed of tubular sections enabling a disassembly of the frame.

11. An exercising apparatus as defined in claim 7 wherein said stringers have end portions bent upwardly from said supporting surface at an angle ranging between substantially 70° and 110°, said end portions merging into said second cross-bar and forming a pair of ancillary handgrips within reach of the user.

12. An exercising apparatus as defined in claim 7 wherein each of said handgrips is provided with a sleeve slidably and rotatably embracing the respective stringers, said sleeve being longitudinally split between a pair of projections bridged by a pivot pin on which the handgrip is fulcrumed to the sleeve for tilting about an axis perpendicular to the respective stringers, said self-locking formations being coacting surfaces on the sleeve and on the handgrip engaging each other in an extreme tilting position.

13. An exercising apparatus as defined in claim 7 wherein said frame is substantially rectangular, said limbs being a pair of stringers extending along the major sides of the rectangle, said transverse member being a first cross-bar extending at one minor side of the rectangle and defining with said stringers a plane parallel to said supporting surface, said frame further including a second cross-bar elevated above said plane at the opposite minor side of the rectangle.

14. An exercising apparatus for the application of traction to the body of a user, comprising:

a rigid frame adapted to slide on a generally horizontal supporting surface, said frame having a pair of parallel limbs interconnected by at least one transverse member and separated by a distance greater than the width of the user's body;

strap means engageable with the user's body;

fastening means for securing said strap means to said transverse member; and a pair of adjustable handgrips on said limbs within reach of a user recumbent therebetween on said supporting surface and tied to said frame by said strap means, said handgrips being independently displaceable on said limbs and being provided with self-locking formations for clamping said handgrips in selected operating positions upon manual stressing of said handgrips by the user with reference to said transverse member in a direction applying traction to the user's body, each of said handgrips being provided with a sleeve slidably and rotatably embracing the respective limb, said sleeve being longitudinally split between a pair of projections bridged by a pivot pin on which the handgrip is fulcrumed to the sleeve for tilting about an axis perpendicular to the respective limb, said self-locking formations being coacting surfaces on the sleeve and on the handgrip engaging each other in an extreme tilting position.

15. An exercising apparatus as defined in claim 13 wherein said handgrips have free ends pointing away from said second cross-bar in said extreme tilting position.

16. An exercising apparatus as defined in claim 4 wherein said transverse member forms a unitary tube with said limbs, said tensioning means being a resilient element passing through said transverse member.

* * * * *